US011044994B2

(12) United States Patent
Heap et al.

(10) Patent No.: US 11,044,994 B2
(45) Date of Patent: Jun. 29, 2021

(54) ADJUSTABLE ZERO-CLEARANCE SHELVING BRACKET AND SHELF ASSEMBLY

(71) Applicants: Brock Heap, West Burlington, IA (US); Justin Henning, West Burlington, IA (US); Ryan Oleson, West Burlington, IA (US)

(72) Inventors: Brock Heap, West Burlington, IA (US); Justin Henning, West Burlington, IA (US); Ryan Oleson, West Burlington, IA (US)

(73) Assignee: KPI CONCEPTS, INC., West Burlington, IA (US)

( * ) Notice: Subject to any disclaimer, the term of this patent is extended or adjusted under 35 U.S.C. 154(b) by 0 days.

(21) Appl. No.: 16/439,862

(22) Filed: Jun. 13, 2019

(65) Prior Publication Data

US 2019/0380492 A1 Dec. 19, 2019

Related U.S. Application Data

(60) Provisional application No. 62/684,408, filed on Jun. 13, 2018.

(51) Int. Cl.

| | |
|---|---|
| ***A47B 96/02*** | (2006.01) |
| ***A47B 57/16*** | (2006.01) |
| ***A47B 57/42*** | (2006.01) |
| *A47F 5/00* | (2006.01) |

(52) U.S. Cl.

CPC ..... *A47B 96/028* (2013.01); *A47B 57/16* (2013.01); *A47B 57/42* (2013.01); *A47B 96/025* (2013.01); *A47F 5/0043* (2013.01)

(58) Field of Classification Search

CPC ..... A47B 57/42; A47B 57/56; A47B 57/06; A47B 96/027; A47B 96/061; A47B 96/068; A47B 57/16; A47B 96/028; A47B 96/025; A47F 5/0043

USPC ..... 108/108; 248/235, 243

See application file for complete search history.

(56) References Cited

U.S. PATENT DOCUMENTS

| | | | | | |
|---|---|---|---|---|---|
| 1,299,176 | A * | 4/1919 | Hadler | A47B 57/56 | 248/246 |
| 3,966,158 | A * | 6/1976 | Boundy | A47B 57/42 | 248/243 |
| 4,154,419 | A * | 5/1979 | Breidenbach | A47B 57/402 | 108/110 |
| 4,431,155 | A * | 2/1984 | Engel | A47B 96/061 | 108/108 |
| 4,455,007 | A * | 6/1984 | Varon | A47F 5/00 | 248/251 |

(Continued)

*Primary Examiner* — Jose V Chen

(74) *Attorney, Agent, or Firm* — David M. Breiner; BrownWinick Law Firm

(57) ABSTRACT

Disclosed is a shelving system comprising a vertical surface and at least one shelving bracket, wherein the shelving bracket comprises a first projection in the form of an integral hook-shaped fastening element on the upper portion of one end of a bracket element; a second projection in the form of an aligning projection on the lower portion of said end of the bracket element; and a hollow tube-like support element, wherein the opposite end of the bracket element extends internally to one end of support element and toward the opposite end of the support element.

16 Claims, 27 Drawing Sheets

(56) References Cited

U.S. PATENT DOCUMENTS

| | | | | | |
|---|---|---|---|---|---|
| 4,712,286 | A * | 12/1987 | Wolf | A47B 57/40 | 138/160 |
| 4,895,331 | A * | 1/1990 | Nehls | A47B 57/565 | 108/108 |
| 5,230,492 | A | 7/1993 | Zwart et al. | | |
| D416,471 | S * | 11/1999 | Wurdack | D8/363 | |
| 6,378,255 | B1 | 4/2002 | Eich et al. | | |
| 6,978,975 | B1 | 12/2005 | Magnusson | | |
| 7,575,212 | B1 * | 8/2009 | Langelius | A47B 57/42 | 211/192 |
| 9,456,692 | B2 * | 10/2016 | Tibbe | A47B 96/061 | |
| 9,867,464 | B1 * | 1/2018 | Kokenge | A47B 96/028 | |
| 10,368,639 | B1 * | 8/2019 | Lai | A47B 96/14 | |
| 2005/0127016 | A1 | 6/2005 | Fisher | | |
| 2010/0084354 | A1 | 4/2010 | Eustace | | |
| 2015/0335155 | A1 | 11/2015 | Winker | | |
| 2016/0000219 | A1 * | 1/2016 | Lager | A47B 57/40 | 248/220.43 |
| 2018/0116427 | A1 * | 5/2018 | Gupta | A47F 5/0838 | |

* cited by examiner

ADJUSTABLE ZERO-CLEARANCE SHELVING BRACKET AND SHELF ASSEMBLY

CROSS REFERENCE TO RELATED APPLICATION

This application claims benefit of U.S. Provisional Application No. 62/684,408 which was filed on Jun. 13, 2018, the entirety of which is incorporated herein fully by reference.

TECHNICAL FIELD

The disclosure relates to the field of storage shelving. More, specifically, this disclosure relates to storage shelving systems for providing adjustable shelving with zero-clearance under the shelving bracket.

BACKGROUND

Storage organizers, shelving units, and other storage systems are known in the art. Such storage organizers or shelving units may be affixed to a wall for additional structural support, or may be free-standing. Shelving units of this nature typically include a least one vertical shelving upright that secures to the wall or a vertical surface for support. While these shelf brackets may address the issue of torsional stress due to heavier loads, they do not address the issue of the need for additional clearance between shelves and under the bracket, in addition to the need for higher load capacity. For example, as shown in FIG. 1, traditional shelf brackets have an elongated profile and distance between upper and lower hook elements, which then tapers toward the opposite edge of the bracket and does not allow for additional clearance between the shelving bracket and the items on the shelves.

Therefore, a need exists for novel adjustable shelf bracket which provides additional clearance between shelving brackets and the items on the shelves. There is also a need for a novel shelving system and apparatus which is able to provide additional clearance between shelving brackets and items on the shelves, as well as high load capacity. There is a further need for a novel shelving system and apparatus which is free-standing that can resist bending and tipping with a higher load capacity. Finally, there exists a need for a novel shelving system and apparatus that has shelves and shelving brackets that are able to fit existing shelving systems without the need for additional fasteners.

SUMMARY

Adjustable shelf mounting systems and apparatuses are provided. In some embodiments, a tube-like shelf bracket is provided and comprises a first projection in the form of an integral hook-shaped fastening element on the upper portion of one end of a bracket element; a second projection in the form of an aligning projection on the lower portion of said end of the bracket element; and a hollow tube-like support element, wherein the opposite end of the bracket element extends internally to one end of support element and toward the opposite end of the support element.

In a further embodiment, a shelf bracket structure is provided and comprises an elongated support strip for attachment in a vertical position to a support surface and having a front wall and rearwardly extending portions spacing said front wall from said support surface, said strip having a plurality of holes extending through said front wall and spaced uniformly along said strip; a tube-like shelf bracket having a first projection in the form of an integral hook-shaped fastening element on the upper portion of one end of a bracket element; a second projection in the form of an aligning projection on the lower portion of said end of the bracket element; and a hollow tube-like support element, wherein the opposite end of the bracket element extends internally to one end of support element and toward the opposite end of the support element.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

Figure 1:
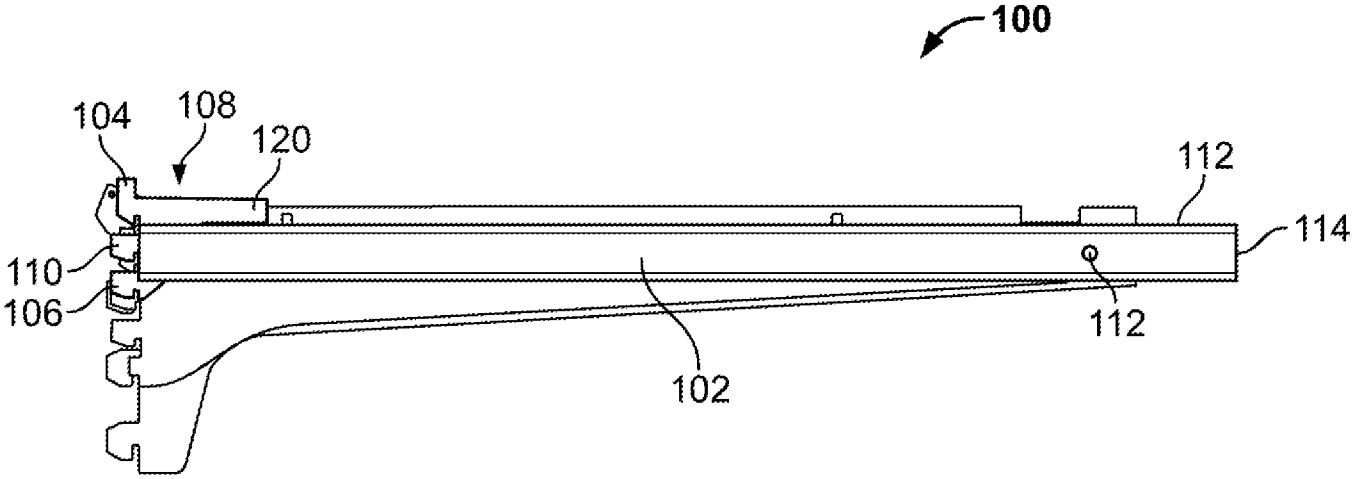
FIG. 1 (PRIOR ART)
FIG. 1 depicts the prior art in comparison to an embodiment of the shelf bracket according to the disclosure.

Various embodiments of the present disclosure will be described in detail with reference to the drawings, wherein like reference numerals represent like parts throughout the several views. Reference to various embodiments does not limit the scope of the disclosure. Figures represented herein are not limitations to the various embodiments according to the disclosure and presented for exemplary illustration of the disclosure.

DETAILED DESCRIPTION

New adjustable shelving systems and apparatuses as well as new adjustable shelving brackets which provide zero clearance between the shelving brackets and the items on the shelves are discussed herein. Example embodiments will now be described more fully with reference to the accompanying drawings. Example embodiments are not intended to limit the disclosure since the disclosure may be embodied in different forms. Rather, example embodiments are provided so that this disclosure will be thorough and complete, and will fully convey the scope of the disclosure to those skilled in the art. In the drawings, the sizes of components may be exaggerated for clarity.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Example embodiments relate to shelving units.

It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form, unless otherwise indicated.

Unless otherwise defined, all terms (including technical and scientific terms) used herein have the same meaning as commonly understood by one having ordinary skill in the art to which this disclosure belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the disclosure, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individuals steps in an unnecessary fashion. Nevertheless, the specification and claims should be read with the understanding that such combinations are entirely within the scope of the disclosure and the claims.

Figure 2:
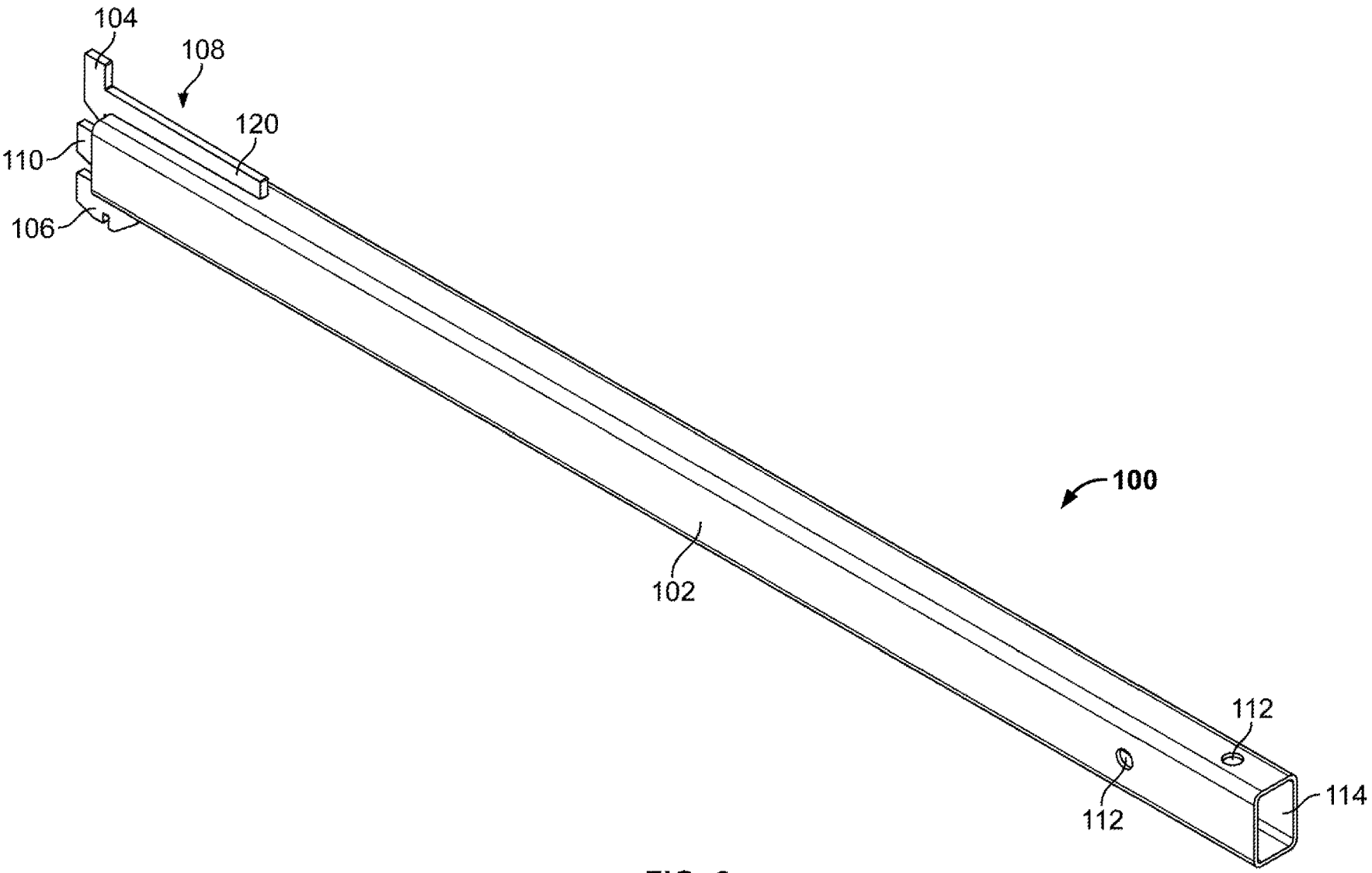
FIG. 2 illustrates a perspective view of a shelf bracket according to an embodiment of the disclosure.
Figure 3:
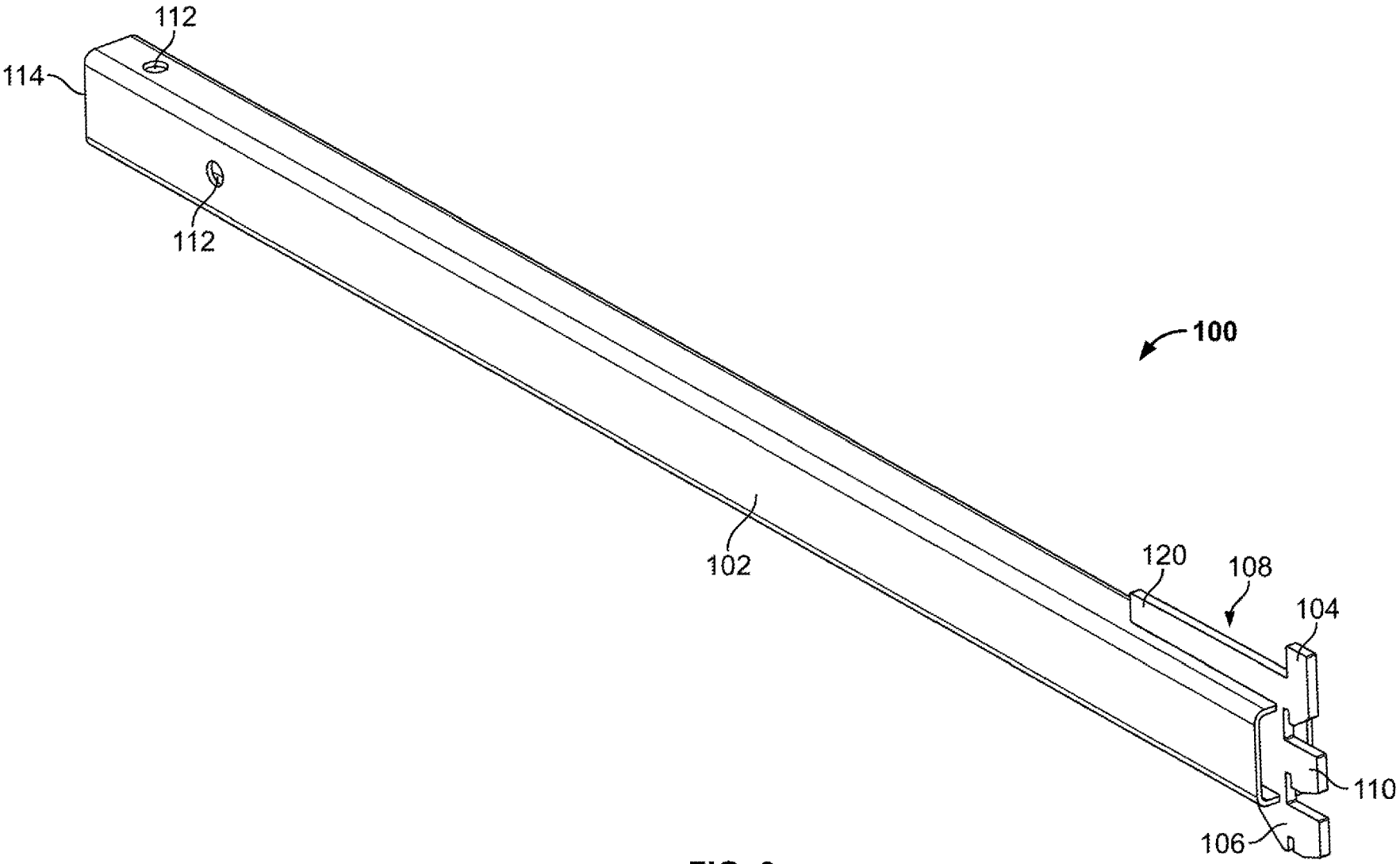
FIG. 3 illustrates another perspective view of a shelf bracket according to an embodiment of the disclosure.
Figure 4:
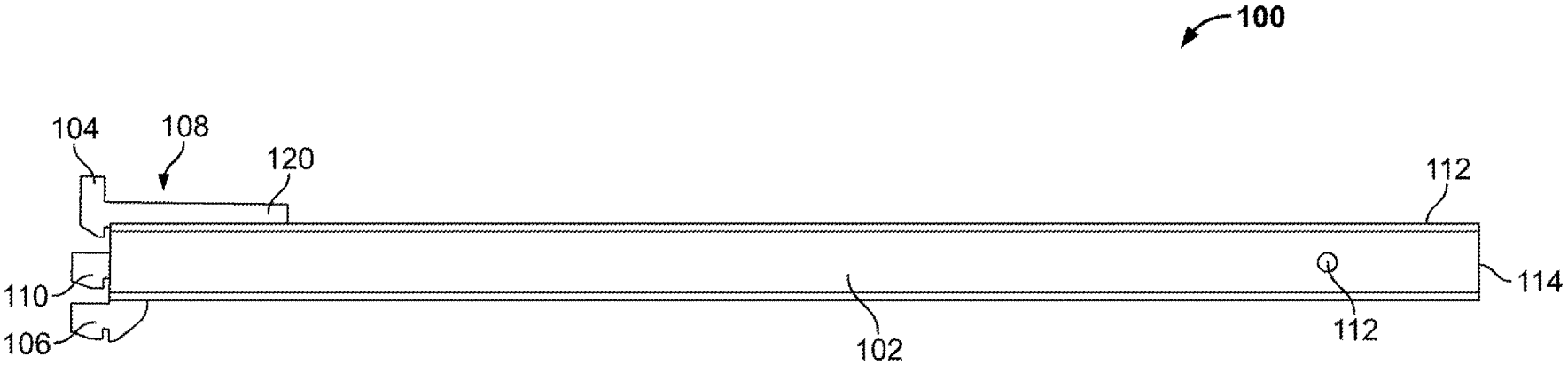
FIG. 4 illustrates a side view of a shelf bracket according to an embodiment of the disclosure.
Figure 5:
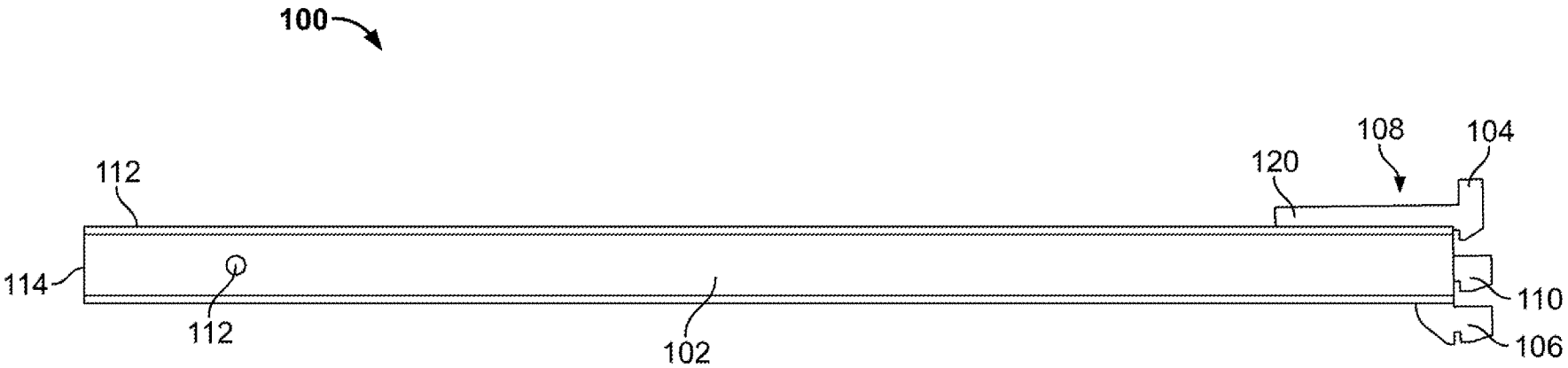
FIG. 5 illustrates another side view of a shelf bracket according to an embodiment of the disclosure.
Figure 6:
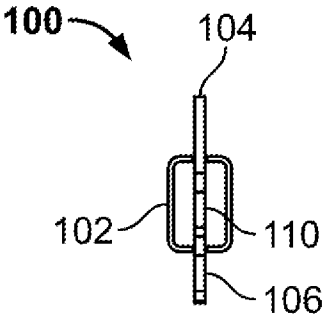
FIG. 6 illustrates an end view of a shelf bracket according to an embodiment of the disclosure.
Figure 7:
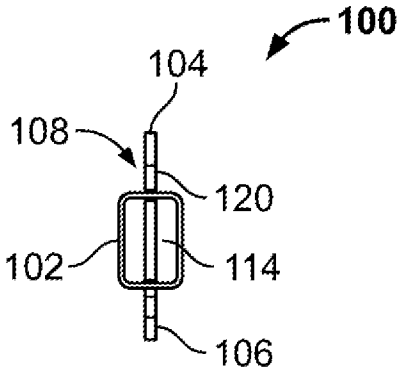
FIG. 7 illustrates another end view of a shelf bracket according to an embodiment of the disclosure.
Figure 8:
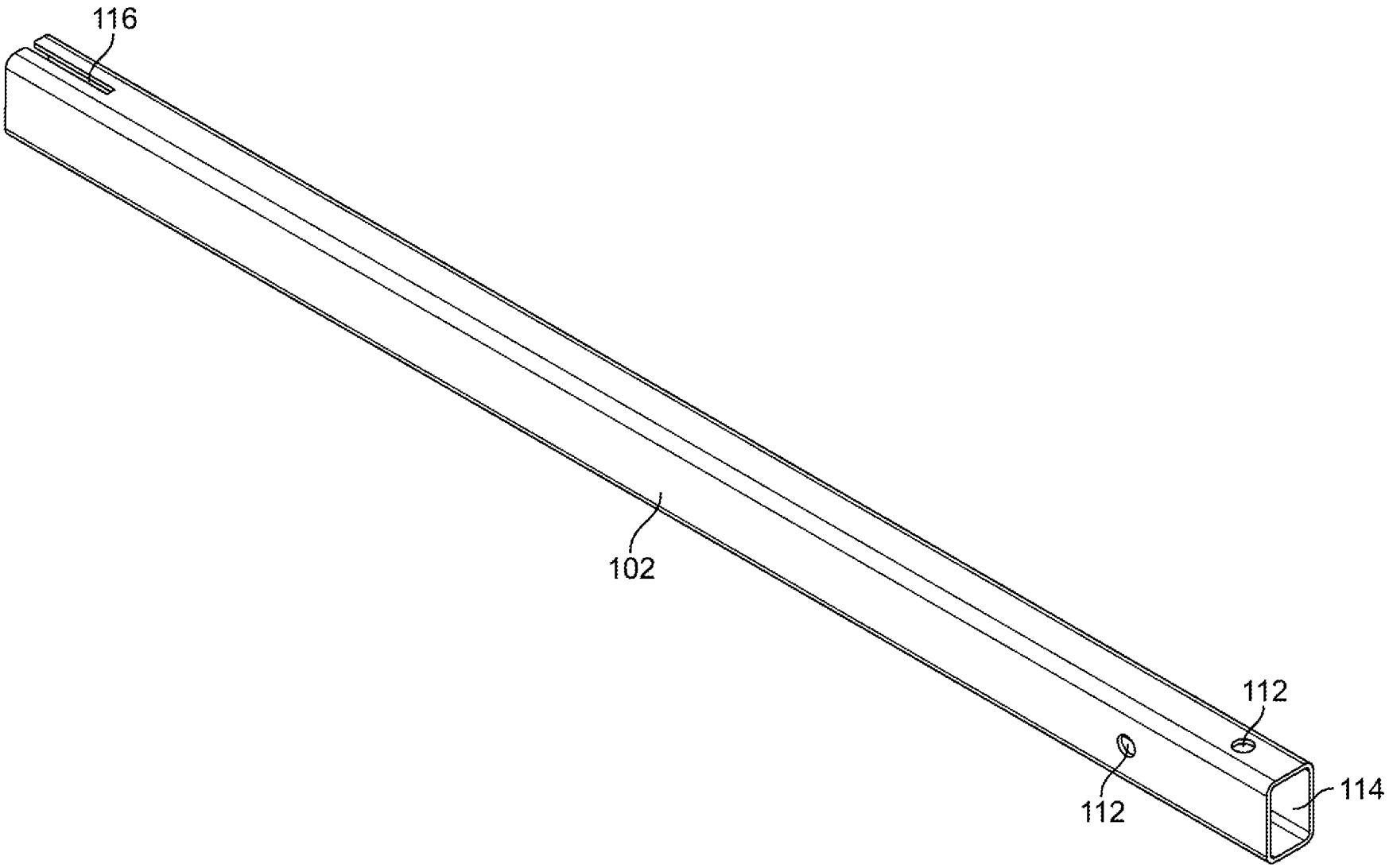
FIG. 8 illustrates a perspective view of the support element of a shelf bracket according to an embodiment of the disclosure.
Figure 9:
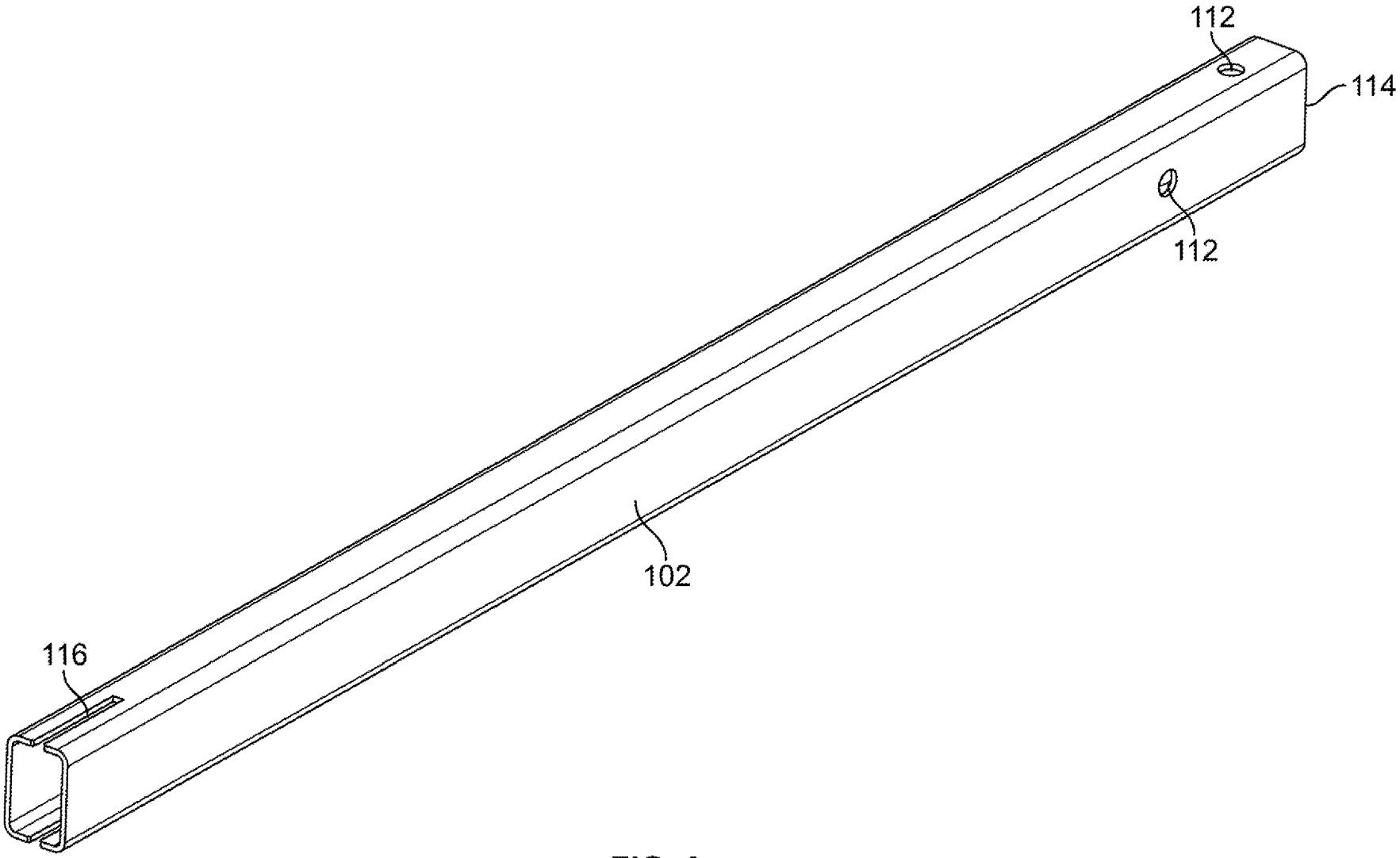
FIG. 9 illustrates another perspective view of the support element of a shelf bracket according to an embodiment of the disclosure.
Figure 10:
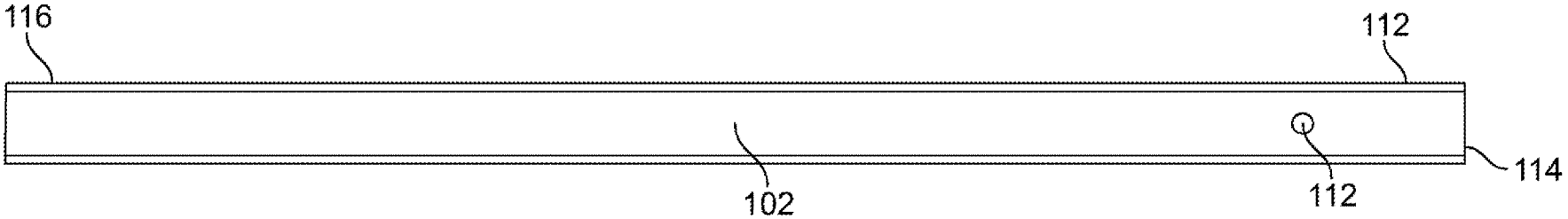
FIG. 10 illustrates a side view of the support element of a shelf bracket according to an embodiment of the disclosure.
Figure 11:
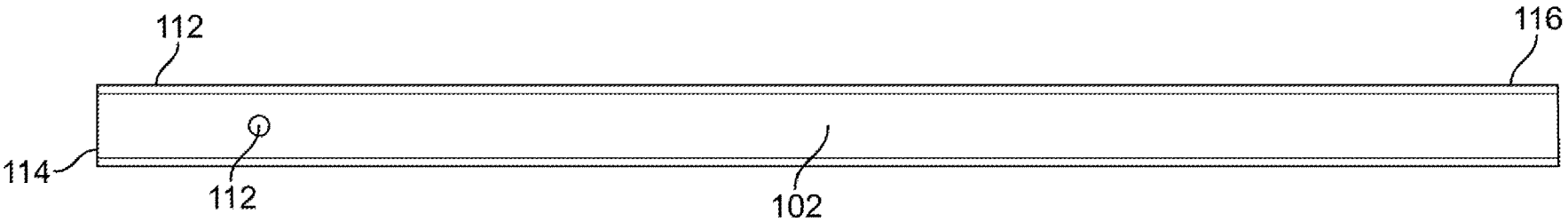
FIG. 11 illustrates another side view of the support element of a shelf bracket according to an embodiment of the disclosure.
Figure 12:
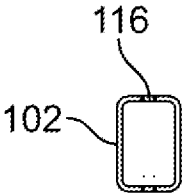
FIG. 12 illustrates an end view of the support element of a shelf bracket according to an embodiment of the disclosure.
Figure 13:
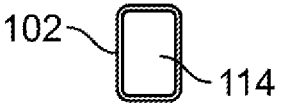
FIG. 13 illustrates another end view of the support element of a shelf bracket according to an embodiment of the disclosure.
Figure 14:
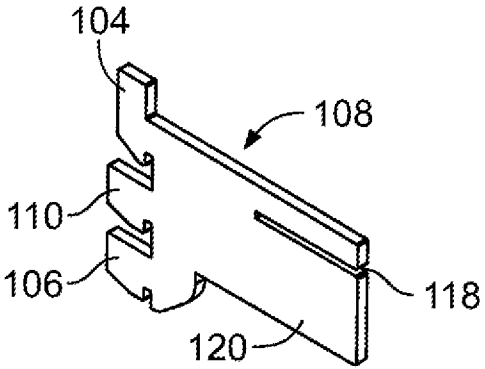
FIG. 14 illustrates a perspective view of the bracket element of a shelf bracket according to an embodiment of the disclosure.
Figure 15:
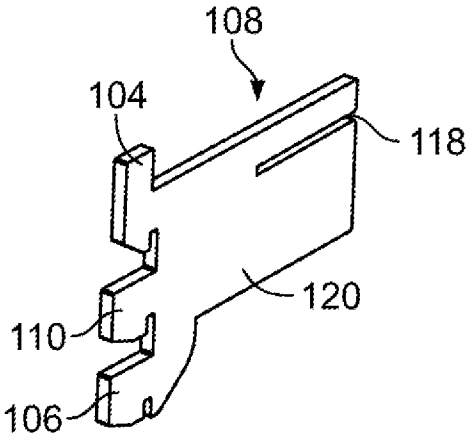
FIG. 15 illustrates another perspective view of the bracket element of a shelf bracket according to an embodiment of the disclosure.
Figure 16:
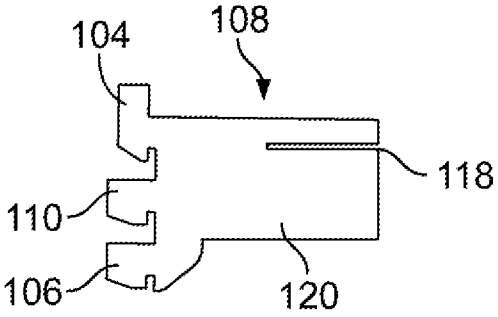
FIG. 16 illustrates a side view of the bracket element of a shelf bracket according to an embodiment of the disclosure.
Figure 17:
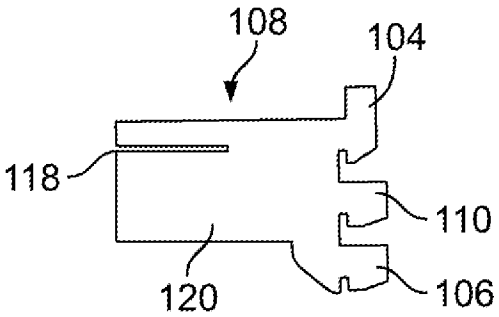
FIG. 17 illustrates another side view of the bracket element of a shelf bracket according to an embodiment of the disclosure.
Figure 18:
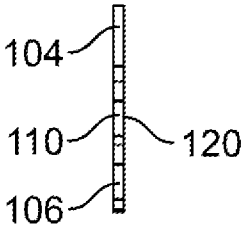
FIG. 18 illustrates an end view of the bracket element of a shelf bracket according to an embodiment of the disclosure
Figure 19:
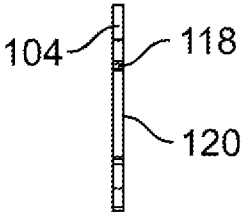
FIG. 19 illustrates another end view of the bracket element of a shelf bracket according to an embodiment of the disclosure.

For purposes of description herein, the terms "upper," "lower," "left," "right," "front," "vertical," "horizontal," and derivatives thereof shall relate to the disclosure as oriented in FIG. 2. However, one will understand that the disclosure may assume various alternative orientations and step sequences, expect where expressly specified to the contrary. Therefore, the specific devices and processes illustrated in the attached drawings, and described in the following specification, are simply exemplary embodiment so the inventive concepts defined in the appended claims. Hence, specific dimensions and other physical characteristics relating to the embodiments disclosed herein are not to be considered as limiting, unless the claims expressly state otherwise.

Figure 20:
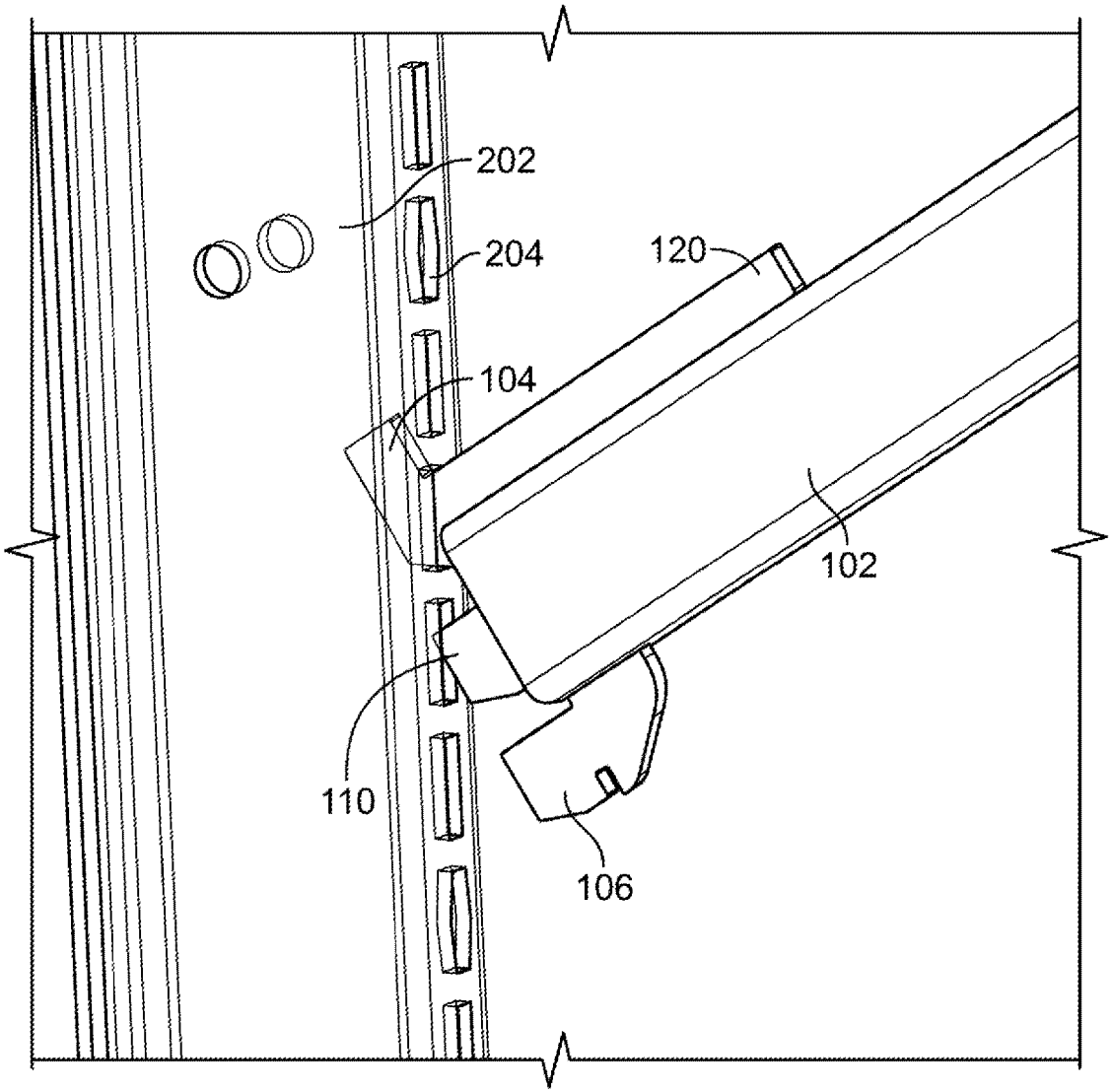
FIG. 20 depicts the interaction between the bracket element of a shelf bracket according to an embodiment of the disclosure and a support strip for attachment in a vertical position to a support surface.
Figure 21:
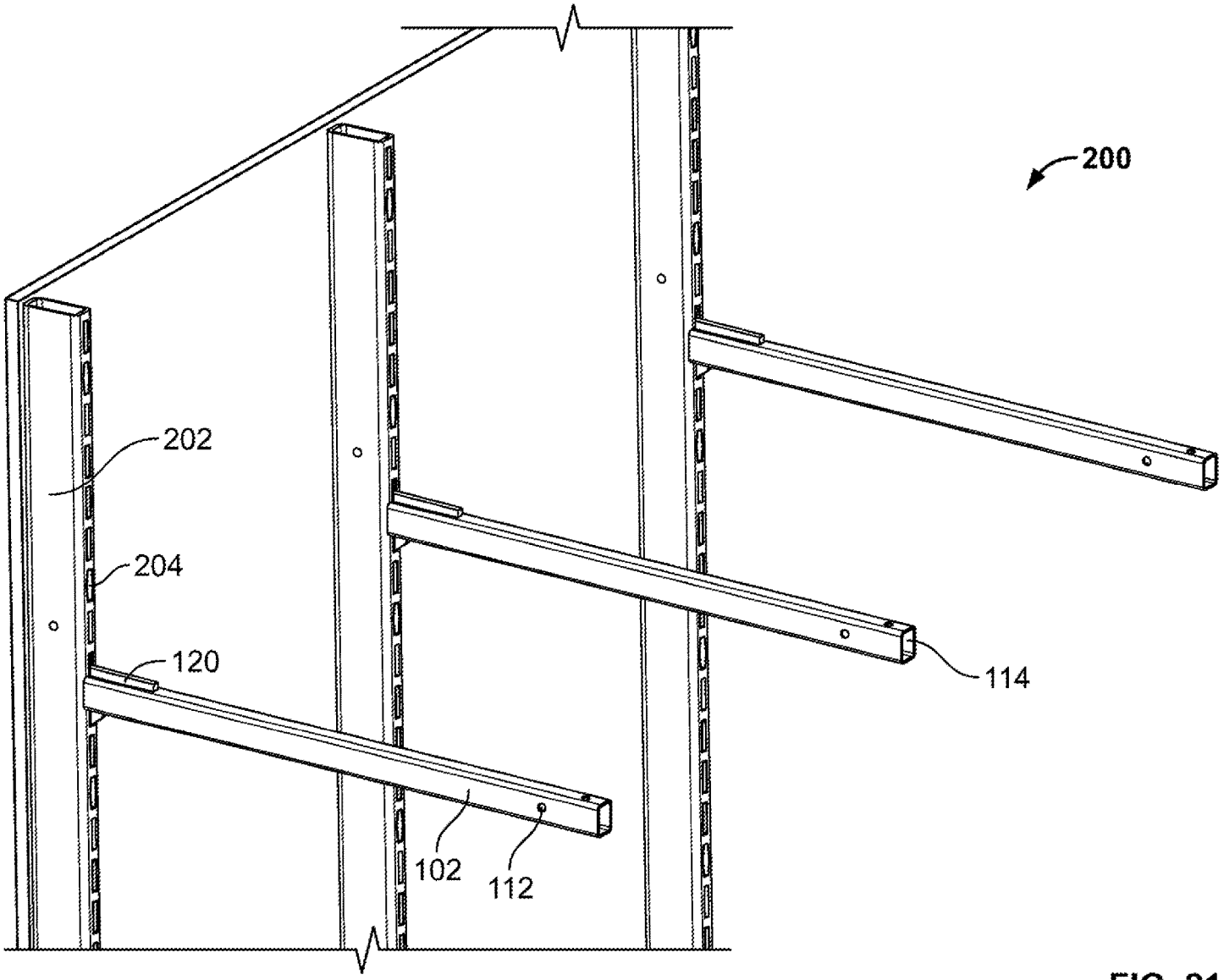
FIG. 21 depicts a shelving system according to an embodiment of the disclosure.
Figure 22:
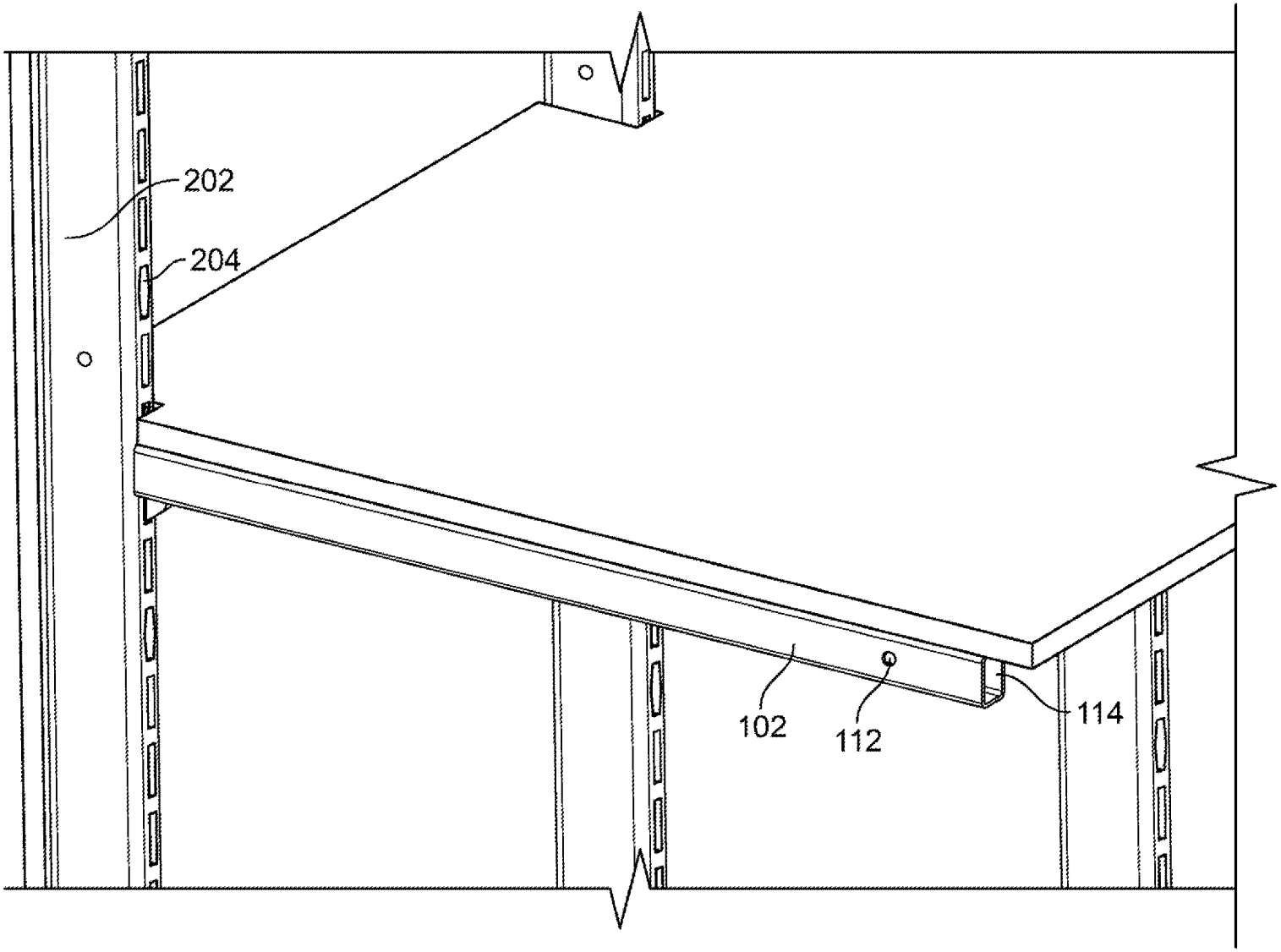
FIG. 22 depicts the interaction between a shelf and a shelf bracket according to an embodiment of the disclosure.
Figure 23:
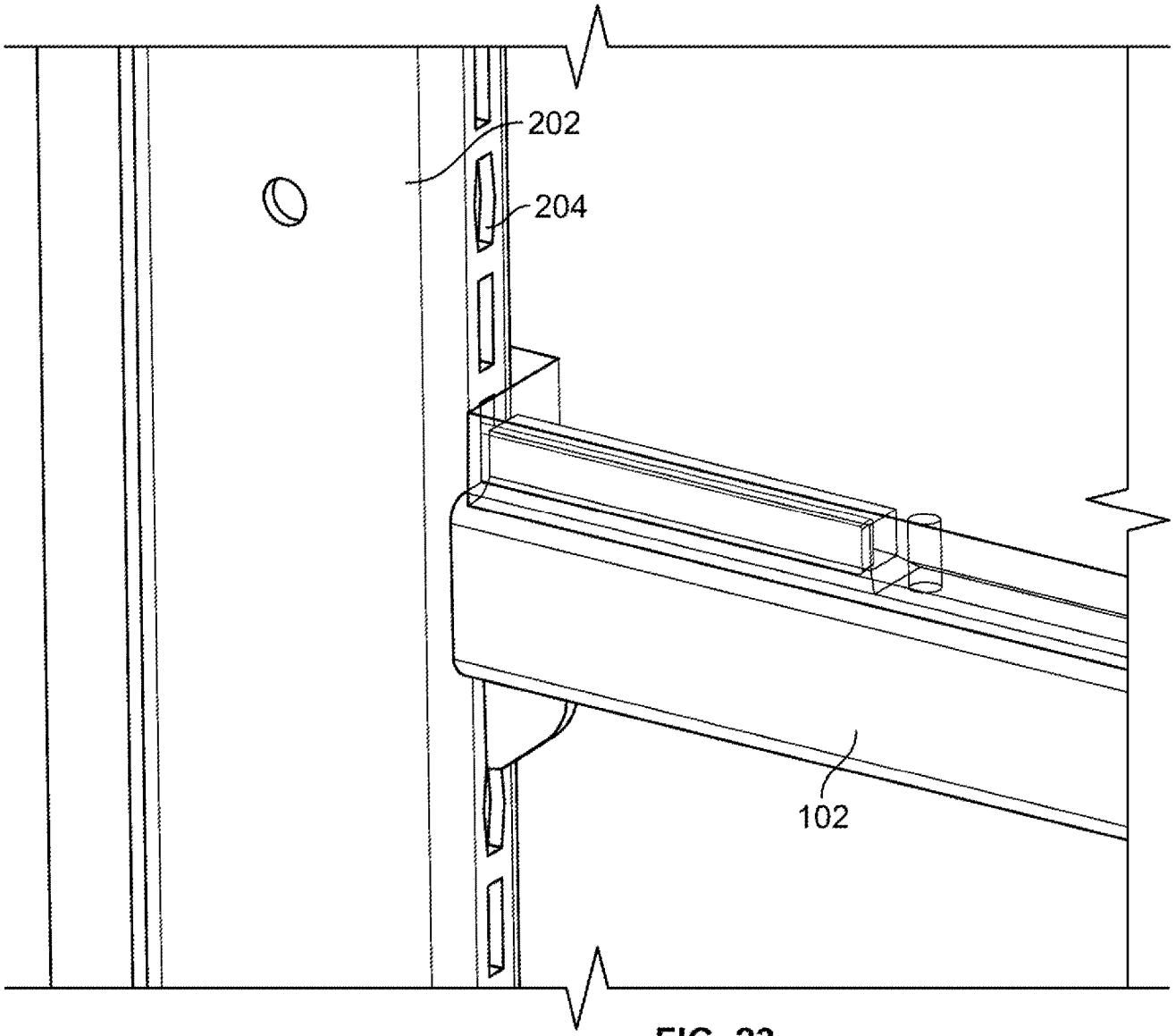
FIG. 23 depicts the interaction between a shelf and a shelf bracket according to an embodiment of the disclosure.
Figure 24:
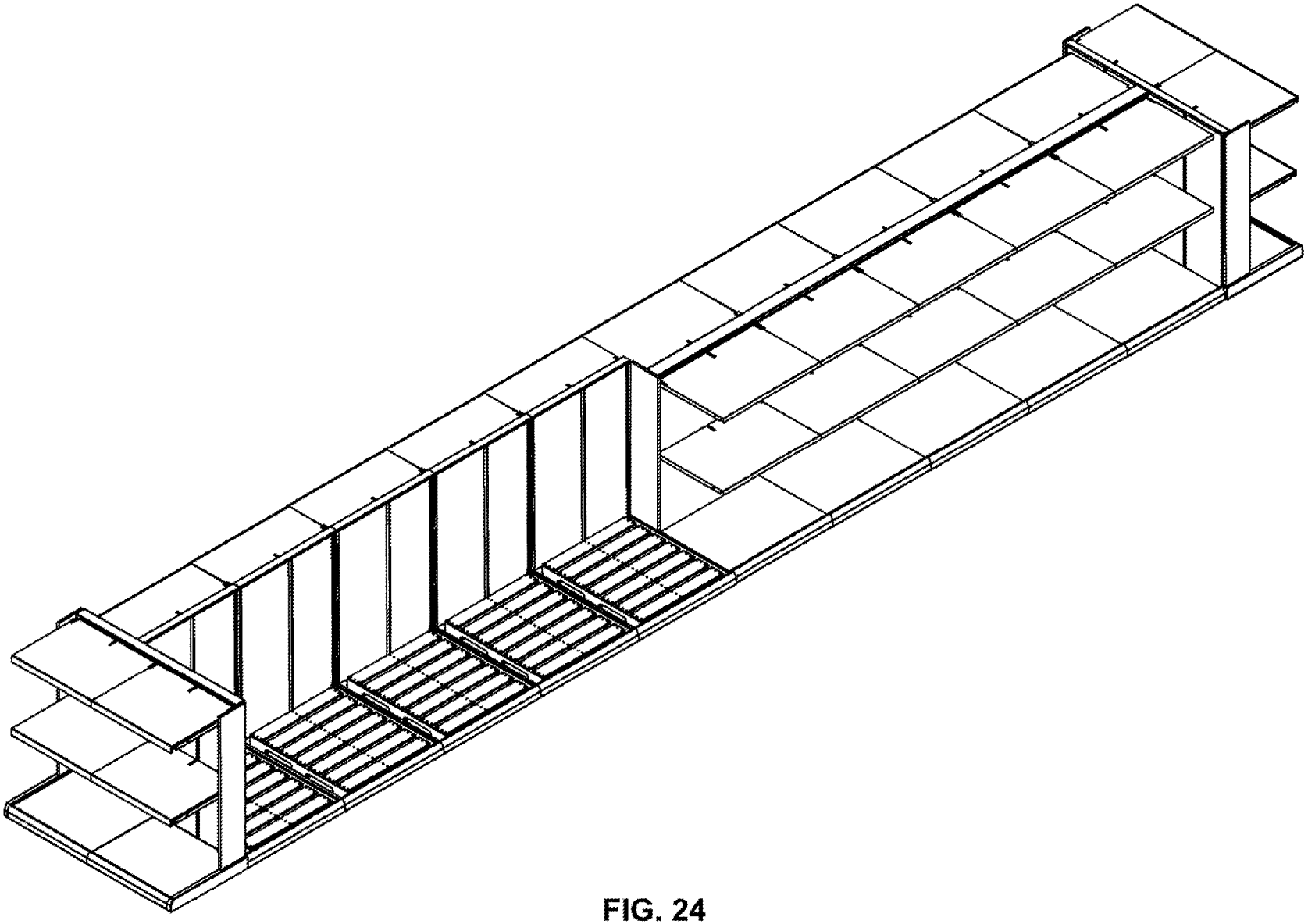
FIG. 24 depicts an alternative shelving system according to an embodiment of the disclosure.
Figure 25:
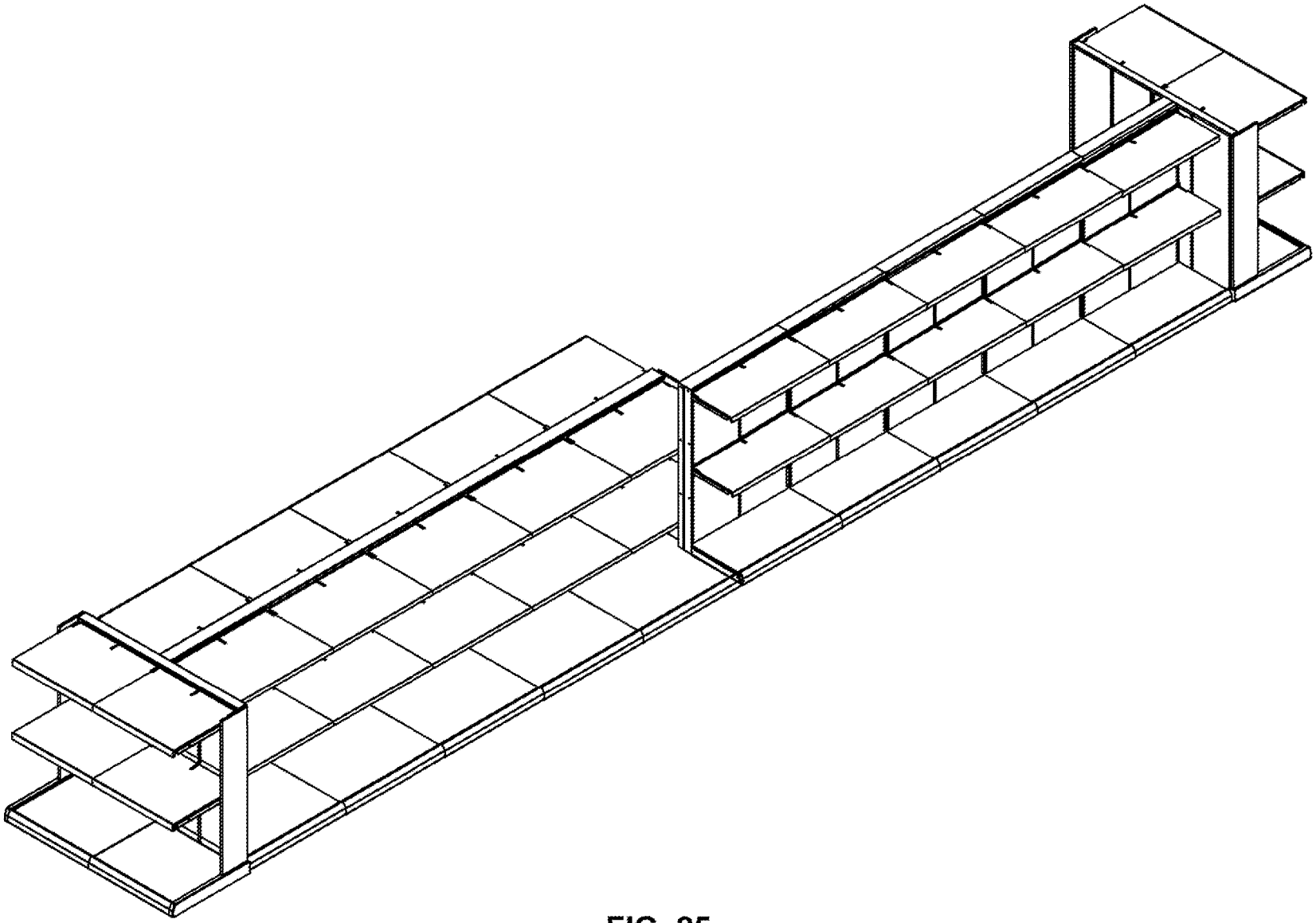
FIG. 25 depicts an alternative shelving system according to an embodiment of the disclosure.
Figure 26:
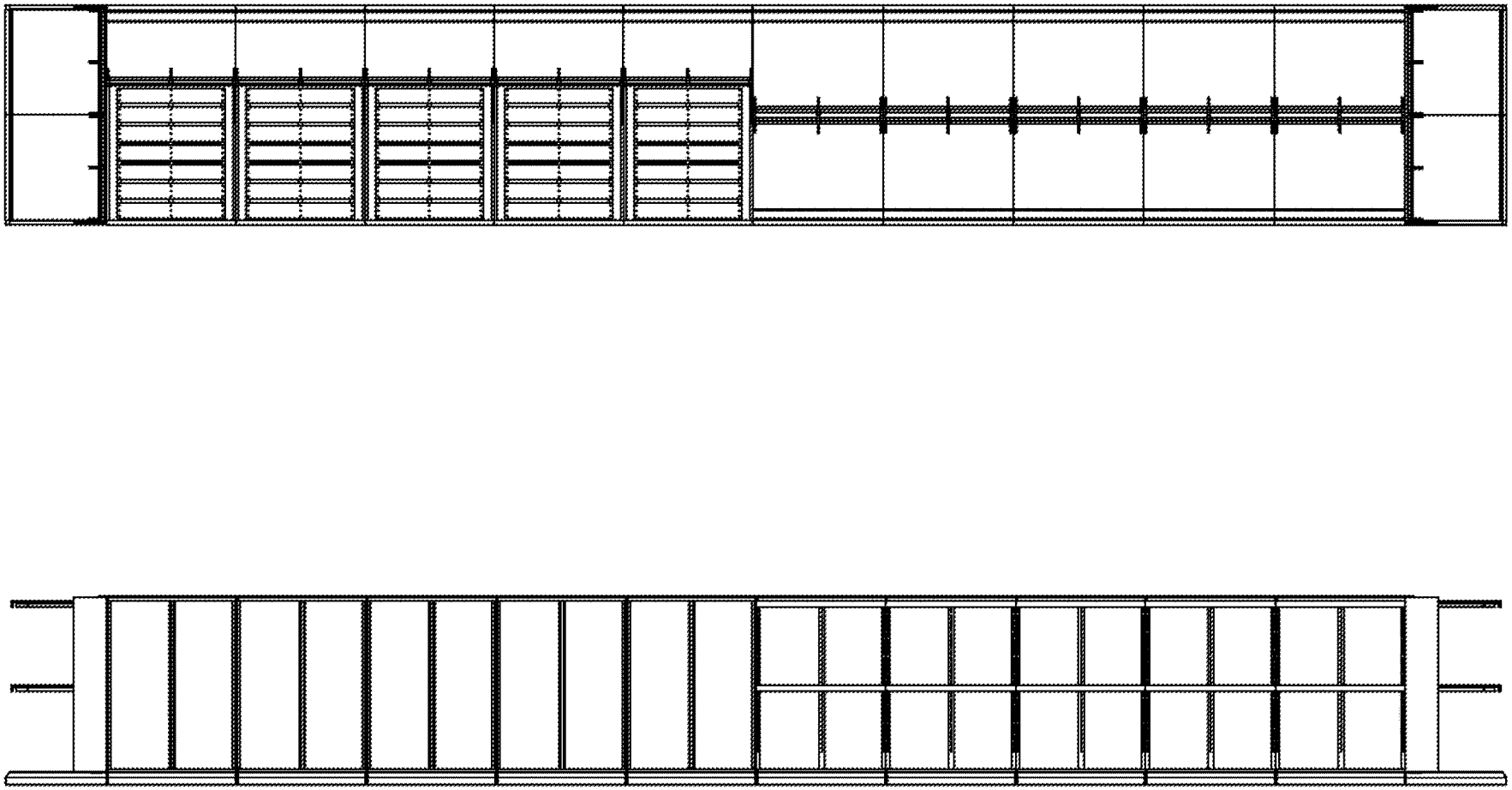
FIG. 26 depicts an alternative shelving system according to an embodiment of the disclosure.
Figure 27:
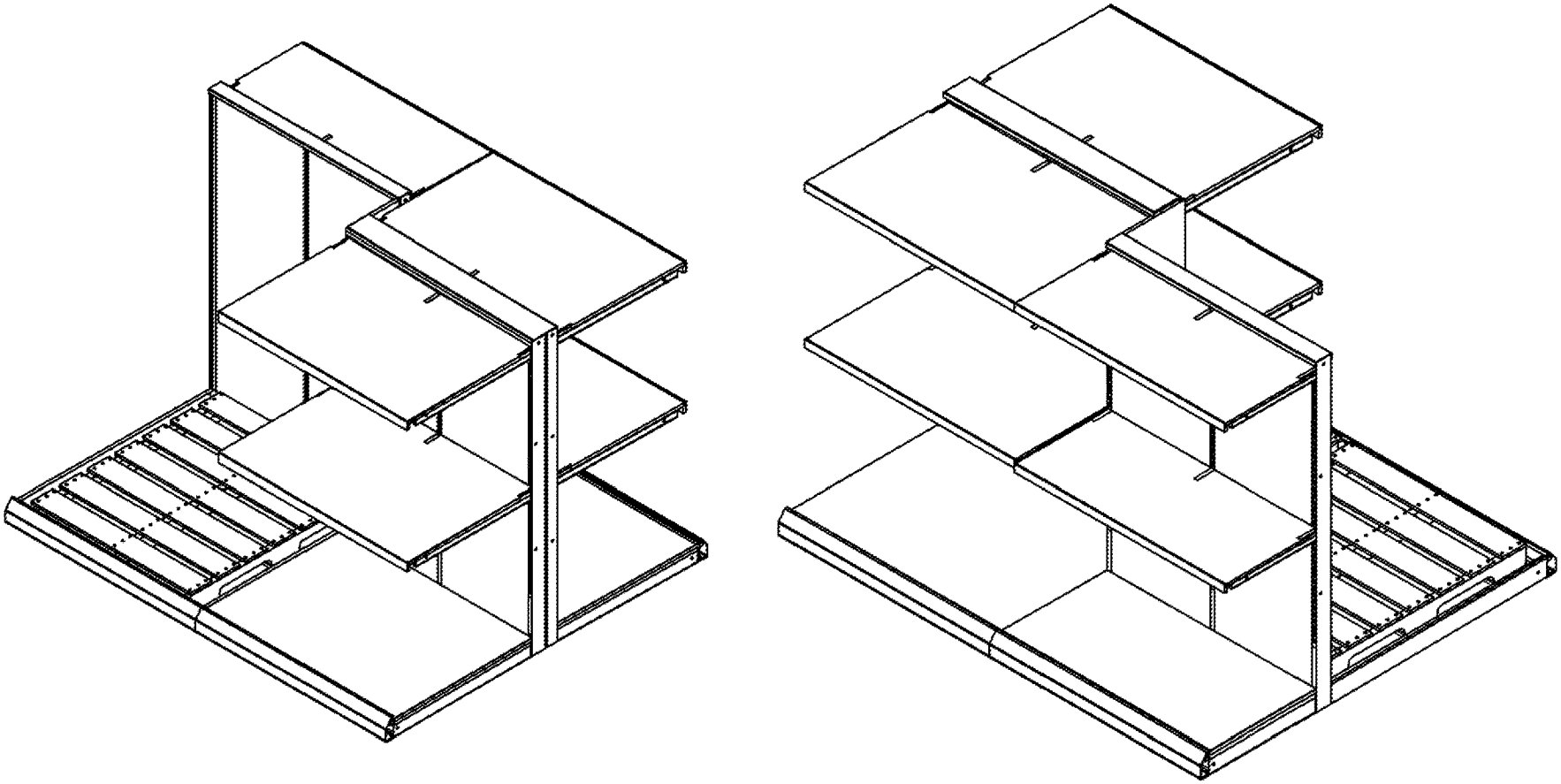
FIG. 27 depicts an alternative shelving system according to an embodiment of the disclosure.

FIGS. 2-7 illustrate an example of the shelving bracket system 100 according to various embodiments. In this example, the shelving bracket system 100 comprises a bracket element 108 and a support element 102. As shown in FIGS. 8-13, the bracket element 108 has an integral hook shaped upper fastening element 104, which is received in a hole of the support strip shown in FIG. 20. An integral aligning projection 106 includes a downwardly extending lug which is received in and fits a second hole of the support strip shown in FIG. 20. In a further embodiment, a centered projection 110 is located between each of the upper projection 104 and lower projection 106 and is received in and fits a third hole of the support strip shown in FIG. 20. The bracket element 108 further comprises a body of the bracket 120 which extends internally into the tube-like support element 102 of the bracket system 100. The bracket element 108 may be removably or fixedly attached to the to the support element 102 via a channel 118 which extends partially through the body of the bracket 120 and is received into a corresponding channel 116 located on one end of the support element 102 as shown in FIGS. 8-13. The tube-like support element 102 is preferably hollow (i.e., having open ends 114) and may be of any shape. For example, the support element 102 may be rectangle-shaped, u-shaped, v-shaped, diamond shaped, or any other suitable shape. Further, the support element 102 may contain a plurality of holes which may be used for fastening a shelf to the shelving bracket 100, as shown in FIGS. 22-23. In a preferred embodiment, the support element 102 is of uniform width and height and does not elongate in width or height at any point during its length. Without seeking to be limited to a particular theory of the disclosure, it is believed the insertion of the bracket element 108 into the tube-like support element 102 provides a cantilever effect which enables the shelving bracket 100 to support from about 1 to about 2000 pounds, preferably from about 500 to about 1800 pounds, and more preferably from about 900 to about 1800 pounds.

In a further aspect of the disclosure, a shelving system 200 is provided as shown in FIGS. 20-27. A portion of a support strip 202 for a shelf bracket 100 is shown in FIGS. 20-23. As most clearly shown in FIG. 23, the support strip 202 is of channel form having a web portion, or a front wall and sidewalls forming the rear portion of the support strip 202. Bracing elements are spaced along the support strip 202 and in conjunction with the end wall of the support strip at the lower end of the support strip 202 and an end wall provided by an upper end element for the support strip 202, divide the channel in the support strip 202 into a plurality of recesses in the rear portion of the support strip 202. The upper end element and a lower end element provide finished ends for the support strip 202.

Each support strip 202 has a hole 204 extending through the web element or front wall into each of the recesses. These holes and recesses are spaced equal distances along the support strip 202. In the specific embodiment shown in the FIG. 23, each of these holes 204 has a substantially square upper portion of a width which is a major part of the width of the web portion of the support strip 202 and which approaches the width of such web portion. Each also includes a slot portion extending downwardly from the square portion of the hole 204. The slot portion is substantially narrower than the square portion of the hole 204 and has a width which is a minor portion of the width of the web element of the support strip 202 or the width of the square portion of this hole 204. Further description of suitable shelving systems and apparatuses can be found in U.S. Pat. No. 3,604,669, which is hereby incorporated by reference in its entirety.

According to an embodiment of the disclosure, a shelf is included in the shelving system 200 as shown in FIGS. 22-23. The shelf according to the disclosure may comprise a load bearing surface and an optional perimeter lip coupled with the load bearing surface. In some embodiments, the shelf may comprise four sides with an optional corner gusset positioned in each corner of the shelf. In one embodiment, the shelf is constructed of any suitable solid material, such as sheets of metal, wood, plastic, or any other suitable material, and has receiving slots which, as shown in FIG. 23, couple to the shelving bracket and provide stability for the load bearing surface. In a further embodiment, the shelf may comprise a wire frame structure which may allow the load bearing surface to be permeable to air, water, small objects, and the like.

In some embodiments, a perimeter lip may extend away from and surround the perimeter of the bottom of the load bearing surface of the shelf. The perimeter lip may also be configured to engage to a rear shelf support surface and/or front shelf support surface of the shelf bracket. Further description of suitable shelving systems and apparatuses can be found in U.S. Pat. No. 9,277,814, which is hereby incorporated by reference in its entirety.

While some materials have been provided, in other embodiments, the elements that comprise apparatuses of the system such as shelving bracket and the shelving system may be made from durable materials such as aluminum, steel, other metals and metal alloys, wood, hard rubbers, hard plastics, fiber reinforced plastics, carbon fiber, fiber glass, resins, polymers, or any other suitable materials including combinations of materials. Additionally, one or more elements of the apparatuses may be made from or comprise durable and slightly flexible materials such as soft plastics, silicone, soft rubbers, or any other suitable materials including combinations of materials. In some embodiments, one or more of the elements that comprise the apparatuses of the system may be coupled or connected together with heat bonding, welding, chemical bonding, adhesives, clasp type fasteners, clip type fasteners, rivet type fasteners, threaded type fasteners, other types of fasteners, or any other suitable joining method. In other embodiments, one or more of the elements that comprise that comprise the apparatuses may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the apparatuses may be coupled by being one of connected to and integrally formed with another element of an apparatus of the system.

Example embodiments of the disclosure have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present disclosure may be practiced otherwise than as specifically described.

What we claim is:

1. A shelving bracket system comprising:

a bracket element having a body, the body having a first end and a second end opposite the first end, the body including a first projection in the form of an integral hook-shaped fastening element on an upper portion of the first end of the body, a second projection in the form of an aligning projection on a lower portion of the first end of the body, and a channel extending in a first direction, the first direction extending from the second end of the body towards the first end of the body; and a support element, wherein a portion of the bracket element is inserted into the support element to provide a cantilever effect and wherein at least a portion of the support element is in the channel so that a portion of the body is inside the support element and another portion of the body is outside the support element, wherein a length of the channel extending in the first direction is longer than a length of the channel extending lateral to the first direction.

2. The shelving bracket system according to claim 1, wherein the body extends internally to one end of the support element and toward an opposite end of the support element.

3. The shelving bracket system according to claim 1, wherein the support element is hollow.

4. The shelving bracket system according to claim 1, wherein the support element is rectangle-shaped.

5. The shelving bracket system according to claim 1, wherein the shelving bracket system is able to support from about 1 to about 2000 pounds.

6. A shelving system comprising:

an elongated support strip;

a bracket element having a body with a first end and a second end opposite the first end, the first end having at least one projection to attach the bracket element to the elongated support strip; and a support element supported by the bracket element, wherein the body has a channel that extends in a first direction, the first direction extending from the second end of the body towards the first end of the body, a length of the channel extending in the first direction being longer than a length of the channel extending lateral to the first direction.

7. The shelving system according to claim 6, wherein the elongated support strip is for attachment in a vertical position to a support surface and having a front wall and rearwardly extending portions spacing said front wall from said support surface.

8. The shelving system according to claim 6, wherein the elongated support strip has a plurality of holes extending through said front wall and spaced uniformly along said strip.

9. The shelving system according to claim 6, wherein the at least one projection includes a first projection in the form of an integral hook-shaped fastening element on an upper portion of the first end of the bracket element.

10. The shelving system according to claim 9, wherein the at least one projection further includes a second projection in the form of an aligning projection on a lower portion of the first end of the bracket element.

11. The shelving system according to claim 6, wherein the support element is hollow.

12. The shelving system according to claim 6, wherein the support element is rectangle-shaped.

13. The shelving system according to claim 6, wherein the shelving bracket system is able to support from about 1 to about 2000 pounds.

14. A shelving system comprising:

a support member having a top wall with a slot;

a bracket element inserted into an end of the support member, the bracket element having a body with a first end and a second end opposite the first end, the body having a first projection in the form of an integral hook-shaped fastening element on an upper portion of the first end of the body, a second projection in the form of an aligning projection, and a channel engaged with the slot of the support member.

15. The shelving system of claim 14, wherein the channel has a longest length extending in a first direction, the first direction extending from a second end of the body to the first end of the body.

16. The shelving system of claim 14, wherein the channel has a width about the same size as a thickness of the top wall of the support member.

* * * * *